US005539163A

United States Patent [19]

Anderson et al.

[11] Patent Number: 5,539,163

[45] Date of Patent: Jul. 23, 1996

[54] LIGHTWEIGHT LOW PROFILE SOUND WALL PANEL

[75] Inventors: Peter L. Anderson, North Reading, Mass.; Gary S. Figallo, Silverspring, Md.; Jerry J. McNeal, Jr., Mechanicsville, Va.; Eugene A. Lamberson, Monticello, Ind.

[73] Assignee: The Reinforced Earth Company, Vienna, Va.

[21] Appl. No.: 234,162

[22] Filed: Apr. 28, 1994

[51] Int. Cl.[6] ..... E04H 17/00

[52] U.S. Cl. ..... 181/210; 52/144

[58] Field of Search ..... 181/210, 285, 181/286, 290, 294, 295; 52/144, 145

[56] References Cited

U.S. PATENT DOCUMENTS

| | | | |
|---|---|---|---|
| 4,325,457 | 4/1982 | Docherty et al. | 181/210 |
| 4,899,498 | 2/1990 | Grieb | 52/144 |
| 5,314,744 | 5/1994 | Walter et al. | 428/326 |
| 5,324,469 | 6/1994 | Walter et al. | 264/234 |
| 5,392,572 | 2/1995 | Elmore et al. | 52/144 |

OTHER PUBLICATIONS

Technical Manual for Durisol® Sound–Absorptive Noise Barriers (1992).

*Primary Examiner*—Khanh Dang
*Attorney, Agent, or Firm*—Banner & Allegretti, Ltd.

[57] ABSTRACT

Decreased weight, improved sound transmission loss, and maintained sound absorption and durability are all achieved by a highway barrier incorporating a new acoustic barrier panel. The panel remains of the type suitable for being forms, in combinations of multiple panels and multiple, earth-anchored or structure-mounted support posts, into sound barrier walls for use along highways, other rights of way, and the like. The invented acoustic barrier panel comprises a sandwich of slabs. The sandwich comprises a central slab, a first, outer slab sandwich alongside the central slab, and a second, outer slab sandwiched alongside the central slab, opposite the first outer slab. Uniquely, a first grout curtain is interposed between and joins the central slab and the first, outer slab, while a second grout curtain is interposed between and joins the central slab and the second, outer slab. As most preferred, all slabs constitute Durisol™ wood concrete. Welded wire mesh or galvanized welded wire fabric or geotextile fabric or geogrid or other synthetic or metallic reinforcement may reinforce the panels. With panel thicknesses ranging from two and three quarter inches to seven inches, panel weights have been found to be in the range of eighteen to forty pounds per square foot (PSF). At least one known, current highway project specification requires a panel weight of less than twenty PSF and a sound transmission loss of at least twenty-three dB. A prototype panel as invented with a two and three quarter inch thickness has exhibited a weight of nineteen PSF and a sound transmission loss of twenty-eight dB. Sound transmission loss across the panel as invented has been a minimum of twenty-eight dB at all frequencies while loss across past and other panels has been much less.

8 Claims, 2 Drawing Sheets

FIG. 3
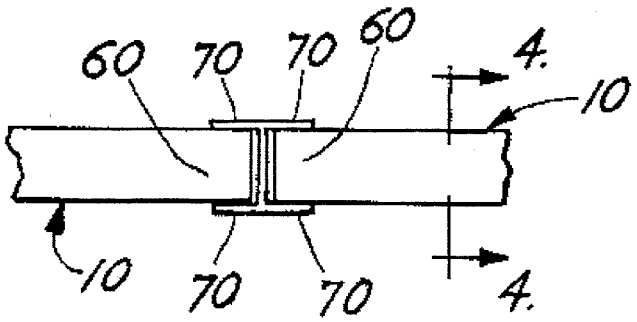
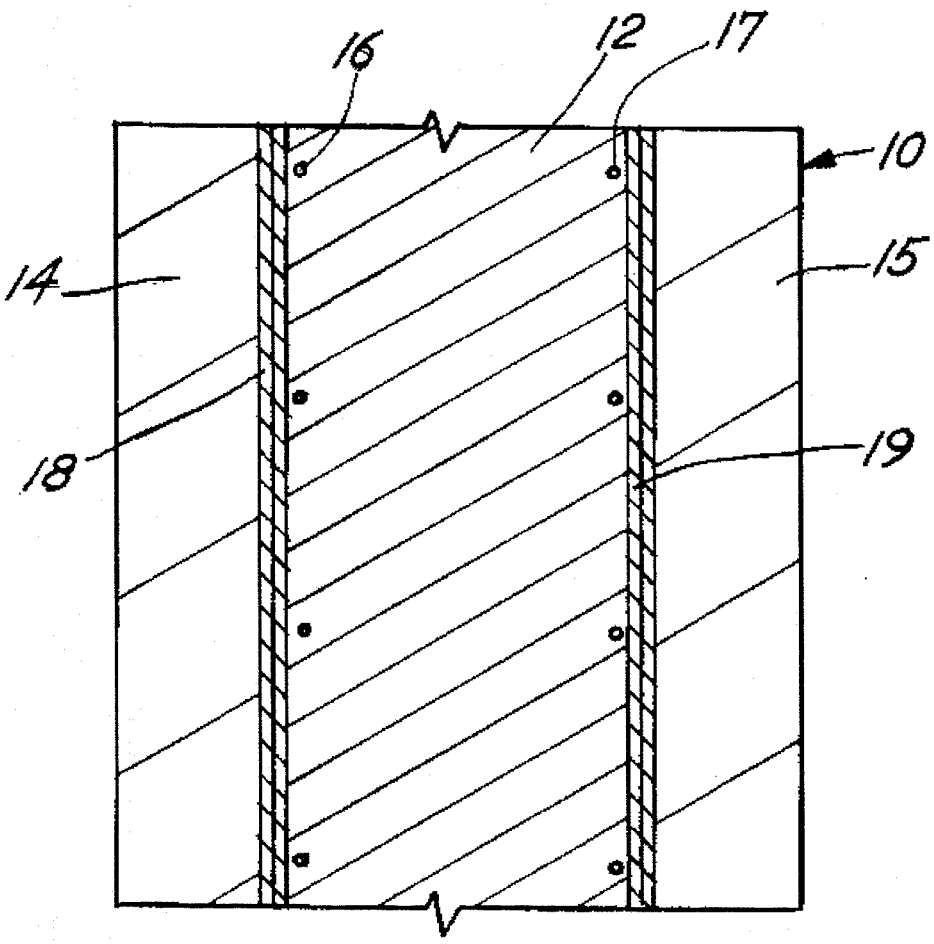
FIG. 4

LIGHTWEIGHT LOW PROFILE SOUND WALL PANEL

BACKGROUND OF THE INVENTION

This invention relates to barriers (hereafter "sound barriers") for use along highways, railroads, airports, and other transportation facilities, and industrial areas and the like, whether the barriers be mounted on the ground or on structures, and to acoustic panel assemblies useful in such barriers as well as in other constructions.

The need for sight, sound and security barriers in urban and industrial environments to control highway, railway and rapid transit sounds and sights is well recognize. In the past and presently, some barriers have been mere fences, often made of wood. In more recent times, increased urban densities, higher traffic spas and volumes, high percentages of loud truck traffic, and a heightened environmental awareness of the problem of noise has led to increased sophistication in the construction of sound barriers. A relatively common construction of a sound barrier now includes concrete or steel flanged posts mounted in or bolt to concrete foundations in the ground, or mount on parapets or bridges or other structures. Distances between posts range from approximately eight feet to twenty feet and more. Concrete, plastic or wood panels in lengths which span between the posts are stacked atop one another to desired heights, with panel ends slid between the post flanges. Constructions of this type have numerous advantages, including speed of erection, low cost, opportunity for disassembly, if necessary, and portability for reassembly at another location. These barriers typically provide some reduction of sound transmission through the wall materials, but are usually accompanied and burden by heavy material weights. Most of the materials reflect sound, which decreases barrier effectiveness in both single wall and parallel wall configurations where, for example, barriers on the opposite side of a highway reflect sound and create reverberating noise which decreases barrier effectiveness.

An advantageous advance in sound barriers has been the utilization of Durisol™ products in such barriers. Durisol™ products are available in the United States from The Reinforced Earth Company, Vienna, Va. Durisol™ products utilize Portland Cement and long, thin, specially treated wood shavings as the aggregate. The resulting wood concrete is hard, lightweight, porous, free draining to water, resistant to rapid and severe freezing and thawing cycles, even in the presence of road de-icing chemicals, resistant to attack by termites and vermin, has low smoke generation and flame spread characteristics, and has thermal insulating properties. Due to its porous nature, it is also sound absorptive. These qualities have made Durisol™ a product suited for use in many applications, including block wall forms, concrete forms, roof plank, and insulating cores for wall panels. The utilization of Durisol™ wood concrete products as construction materials predates the 1940's in Europe. Durisol™ products have also been made for over 30 years in Canada. Durisol™ products are presently manufactured in the Netherlands, Austria, Morocco, France, Spain, Italy, Hungary, Germany, Yugoslavia, Japan, Algeria, and the United States.

Durisol™ products have significant air voids, and the wood concrete construction is lighter than Portland cement concrete made with natural sand and aggregates. Sound barrier panels may be faced with Durisol™ material by layering Durisol™ material, concrete, and more Durisol™ material in panel molds. The resulting Durisol™ faced panels are durable but lightweight relative to other concrete panels. Durisol™ panels are also sound absorbent relative to other concrete panels. Effectiveness of sound barriers constructed with Durisol™ faced panels is improved from one to six additional decibels according to test reports. This is an improvement of ten to sixty percent relative to reflective walls which are designed, generally, to provide 10 decibels of noise reduction.

SUMMARY OF THE INVENTION

Despite the advantages of past sound barrier walls, and especially the advantages of Durisol™ panel walls, improved sound reduction is an important goal of highway barrier walls. Decreased weight and maintained durability are further important goals.

According to the present invention, decreased weight, improved sound transmission loss, and maintained sound absorption and durability are all achieved by a sound barrier incorporating a new acoustic barrier panel. The panel remains of the type suitable for being formed, in combinations of multiple panels and multiple, earth-anchored or structure-mounted support posts in sound barrier walls for use along highways, other transit ways or facilities, and industrial facilities. In contrast with past barrier panels, however, the invented panel comprises a sandwich of slabs constructed and arranged for decreased weight, improved sound transmission loss for improved sound reduction, and maintained sound absorption and durability. The sandwich of the invented panel comprises, first, a central slab. A first, outer slab is sandwiched alongside the central slab, and defines a first face portion of the panel. A second, outer slab is also preferably sandwiched alongside the central panel, opposite the first outer slab, and it defines a second face portion of the panel. Uniquely, a first grout curtain is interposed between and joins the central slab and the first, outer slab, while a second grout curtain is interposed between and joins the central slab and the second, outer slab.

As preferred, the first and second outer slabs of the invented panel constitute Durisol™ wood concrete slabs. As most preferred, the central slab is also a Durisol™ wood concrete slab. Welded wire mesh or galvanized wire fabric or geogrids or geotextile fabric or other synthetic or metallic reinforcement may reinforce the panels against wind loads, and the reinforcement may be alongside the central slab, in or next to the grout curtains.

With panel thicknesses ranging from two and three quarter inches to seven inches, panels weights of the invented panel have been found to be in the range of eighteen to forty pounds per square foot (PSF). Panels have been constructed in the described thicknesses and in lengths of eight to fifteen feet.

At least one known, current highway project specification requires a panel weight of less than twenty PSF and a sound transmission loss of at least twenty-three dB. A barrier wall with these properties is considered desirable. A prototype panel as invented with a two and three quarter inch thickness has exhibited a weight of nineteen PSF and a minimum sound transmission loss of twenty-eight dB at all frequencies.

Comparing the sound deadening property of a panel as invented with prior art and other panels, sound transmission loss across the panel as invented has been twenty-eight dB while loss across past and other panels has been, at most, twenty-three dB.

These and numerous other features and advantages of the invention will be understood from the following description of a preferred embodiment.

BRIEF DESCRIPTION OF THE DRAWING

In the drawing:

FIG. 3 is a plan view of a joint of the barrier of FIG. 1 or FIG. 2; and FIG. 4 is a partial, cross-sectional view on an enlarged scale taken on line 4—4 of FIG. 3, of the preferred panel of the invention.

DETAILED DESCRIPTION OF THE PREFERRED EMBODIMENT

Figure 1:
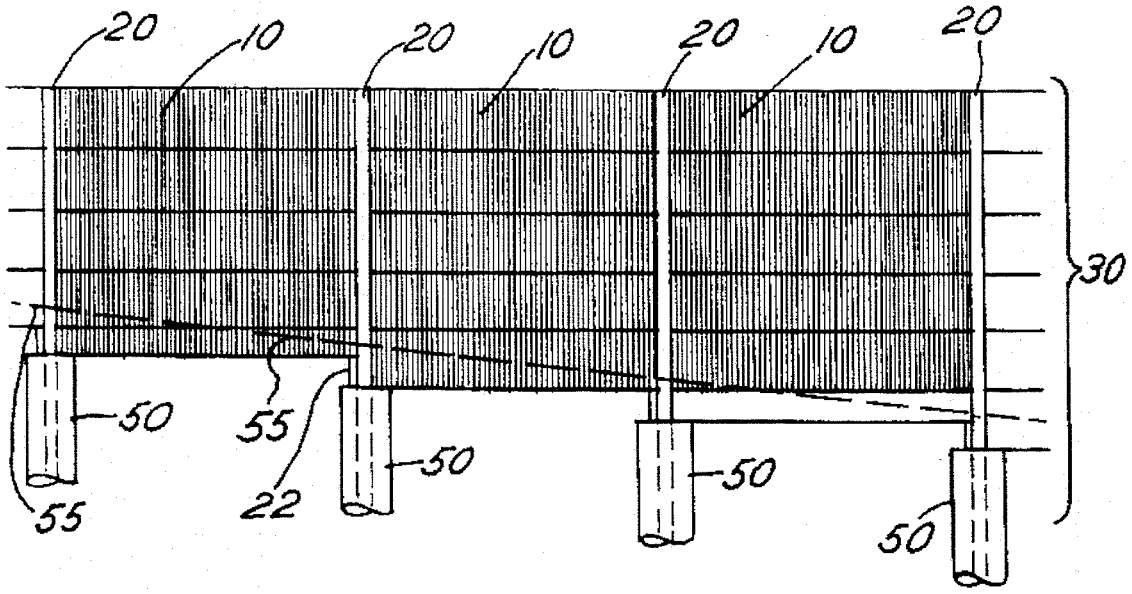
FIG. 1 is an elevational view of a ground-mounted highway sound barrier.
Figure 2:
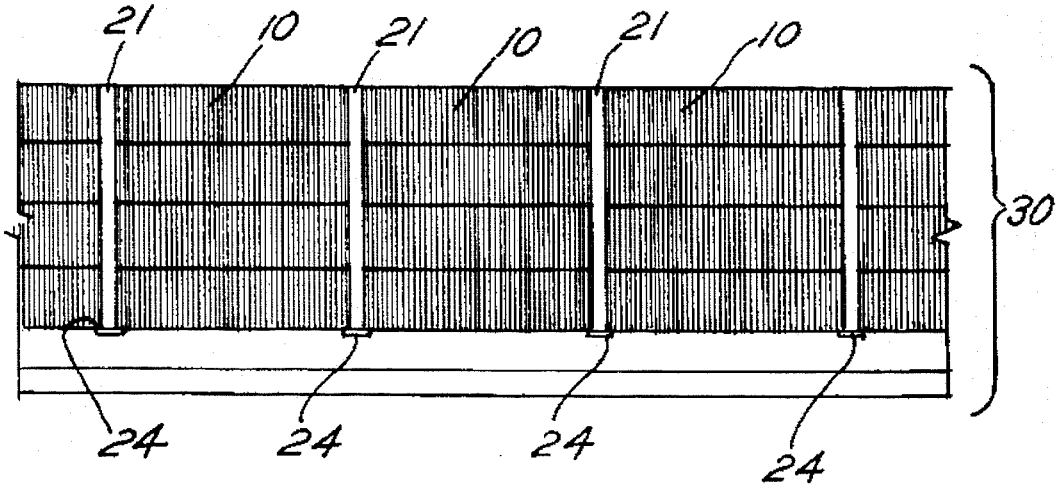
FIG. 2 is an elevational view of a structure-mounded highway sound barrier.

Referring to FIGS. 1 and 2, the preferred panel of the invention is a sound barrier, acoustic or noise barrier panel 10, for forming sound barrier walls 30 for use along highways, other transit ways or around industrial facilities, fights or way or other outdoor noise sources. The walls are formed of combinations of multiple panels 10 and multiple ground-anchored support posts 20, see FIG. 1, or structure-mounted support posts 21, see FIG. 2.

As shown in FIG. 1, ground-anchored posts 20 are preferably hot-dipped galvanized steel and mounted in concrete support shafts 50 at distances in the range of eight to fifteen feet. The concrete support shafts 50 extend below a grade 55, shown in dotted outline in FIG. 1. Spacing of the posts 20 depends on grade and design wind pressure. The top surfaces of the shafts 50 are troweled smooth to provide suitable bearing for the panels. The troweling extends into the webs of the posts 20. As an alternative to steel, posts 20 may be concrete.

As shown in FIG. 2, structure-mounted posts 21 are similar to posts 20, and yet rest on anchor plates 24.

If the grade or underlying structure is level, the walls 30 may also be level, as in FIG. 2, but if the grade or underlying structure is sloped, the walls 30 may conform to the grade or structure, by sloping of the panels 10 and tilting of the posts 20 or 21, or by adjustment of the vertical positioning of the panels 10 as shown in FIG. 1. Beds of gravel are preferably placed on grade beneath the panels 10 for surface drainage. Where needed, the panels may extend below grade. To support ends of panels 10 where needed to assure alignment, due to slope, panel supports 22 may be inserted. The top of wall 30 may be level, as shown, or stepped to follow the grade, as a matter of choice. Also, wall height may be stepped down at the ends of walls for aesthetics, and if surface conditions allow, or if posts require removal or relocation, the posts 20 may also include base plates bolted in place, as opposed to embedment into support shafts 50.

The invented panels 10 are formed in lengths which span between the posts 40 and are stacked atop one another to desired heights. Typical spans are eight to fifteen feet. Greater or lesser spans are possible, as desired. As illustrated in FIG. 3, the panel ends 60 slide between the post flanges 70. Due to the sound absorptive qualities of the invented panels, there is no need for wedging of the panels into the space between the flanges. A gap of approximately one-quarter inch between the Durisol™ sound absorptive material and the posts does not produce a significant sound leak for an average sound barrier of fifteen to twenty-feet height. And because Durisol™ is sound absorptive, the panels do not rattle against the post, vibrate, or otherwise become a source of noise while in service. This is advantageous as opposed to other sound barrier systems which require specific wedging systems and fastening shims, devices or bearing pads.

Cost savings result because of savings in labor achieved by installing the panels with one person from the ground. Panels which require wedging must be installed by a three person crew which must wedge each panel against the flange of each post as each panel is installed.

As can be observed, the ends of the panels are subject to movement relative to the posts, back and forth in the direction of extent of the panel, due to thermal expansion and contraction, and face portions of the panels are exposed to weather and variable wind loadings.

As shown in FIG. 4, each preferred sound barrier panel 10 comprises a sandwich, best seen in cross-section of the panel. In the most preferred embodiment, the sandwich of the panel 10 comprises a central slab 12, a first, outer slab 14, a second, outer slab 15, at least two reinforcing fabrics 16, 17, and at least two grout curtains 18, 19.

The central slab defines a plane by its length and height. The other slabs 14, 15, lie in closely adjacent parallel planes, and the grout curtains 18, 19 also define parallel planes. Both outer slabs 14, 15 are co-extensive with the central slab 12. Thus, the first, outer slab 14 defines a first planar face portion of the panel 10, and the second, outer slab defines a second, planar face portion of the panel 10. Both faces of the panels 10, and the resulting wall 30, may be fluted as shown, or flat, or otherwise, as a matter of choice.

The first grout curtain 18 interposes and joins the central slab 12 and the first, outer slab 14. The second grout curtain 19 interposes and joins the central slab 12 and the second, outer slab 15. As most preferred, the grout curtains 18, 19 are each approximately one-eighth inch thick, and co-extensive with the slabs 12, 14, 15. The grout of the grout curtains is most preferably a dried mixture of Portland cement, sand and water. Alternate grouts are possible.

The first and second outer slabs 14, 15 of the preferred panel 10 constitute Durisol™ wood concrete slabs. As most preferred, the central slab 12 is also a Durisol™ wood concrete slab. The most preferred reinforcing fabric is galvanized wire fabric, although welded wire mesh or geogrids or geotextile fabric or other synthetic or metallic reinforcement may be used as well.

With panel thicknesses ranging from two and three quarter inches to seven inches, panels weights of the invented panel have been found to be in the range of eighteen to forty pounds per square foot (PSF). Greater and lesser thicknesses are possible. The thickness at the ends of the panel may exceed seven inches where the distance between post flanges is greater than seven inches. Panel lengths of eight to fifteen feet are preferred, although greater and lesser lengths are also possible.

At least one known, current highway project specification requires a panel weight of less than twenty PSF and a sound transmission loss of at least twenty-three dB. A barrier wall with these properties is considered desirable. A prototype panel as invented with a two and three quarter inch thickness has exhibited a weight of nineteen PSF and a sound transmission loss of twenty-eight dB.

Comparing the sound reduction property of a panel as invented with prior art and other panels, sound transmission through the panel as invented has been a minimum of twenty-eight dB while loss across past and other panels has been much less. It is believed that at least two grout curtains are necessary to gain the improved sound transmission loss properties of the new panel, but that a panel with more than two grout curtains may also gain the improved properties.

The invented panels 10 are most preferably fabricated in a continuous manufacturing process that produces a true composite structure. Portland cement is the common binder used in both the Durisol™ sound absorptive material of the slabs 12, 14, 15 and the grout curtains 18, 19. The panels 10 are made as true composite structures by casting the Durisol™ slabs 12, 14, 15 and the grout curtains 18, 19 at the same time. Such casting eliminates any potential for delamination. The resulting composite consists of three layers of Durisol™, two grout curtains and two layers of panel reinforcement.

The panel reinforcement most preferably consists of two layers of galvanized steel welded wire fabric in accordance with the Manual of Standard Practice (WRI, 1982) placed at the quarter points of the 2¾ thick Durisol™ panel. Wires in the horizontal direction spaced at several inches on center welded to wires in the vertical direction also spaced at several inches on center creates the welded wire fabric. The panel reinforcement is fabricated in accordance with ASTM A-185 (ASTM, 1990) and provides tensile reinforcement inside each face of the panel for flexure. The standard panel reinforcement is hot dipped galvanized in accordance with ASTM A-123 (1989) and exceeds the minimum reinforcement requirements for flexural members in accordance with ACI 318-89 Section 10.5 (ACI, 1989).

The preferred embodiment, and the manner of making and using it, are now described. To particularly point out and distinctly claim the subject matter regarded as invention, the following claims conclude this specification. Numerous variations in the specific details of the invention and its application will be understood to be within the spirit and scope of the invention and the claims.

What is claimed is:

1. A highway-scale sound barrier panel, for forming in combinations of multiple panels and multiple support posts, sound barrier walls for use along highways and other transit ways, and transportation and industrial facilities, the sound barrier panel comprising a sandwich sized to span distances between said support posts, the sandwich of said panel comprising:

a central slab composed primary of wood concrete;

a first, outer slab defining a first face portion of the panel, the first, outer slab being substantially parallel to and co-extensive with the central slab;

a first grout curtain interposed between and joining the central slab and the first, outer slab; and a second grout curtain alongside the central slab opposite the first grout curtain.

2. The sound barrier panel of claim 1, further comprising a second, outer slab defining a second face portion of the panel, the second, outer slab being substantially parallel to and co-extensive with the central slab, opposite the first, outer slab; the second grout curtain interposed between and joining the central slab and the second, outer slab.

3. The sound barrier panel of claim 2, in which the first and second outer slabs are composed primarily of wood concrete.

4. The sound barrier panel of claim 1, the sandwich further comprising reinforcing fabric, geogrid or mesh within the sandwich.

5. The sound barrier panel of claim 4, wherein said fabric includes galvanized steel welded wire fabric.

6. The sound barrier panel of claim 4, wherein said fabric includes a first layer of fabric adjacent central slab and a second layer of fabric adjacent the central slab opposite the first layer of fabric.

7. The sound barrier panel of claim 1, wherein said grout curtains are each approximately one-eighth inch thick.

8. The sound barrier panel of claim 1, wherein said grout curtains include a dried mixture of Portland cement, sand and water.

* * * * *